US006202785B1

(12) United States Patent
Hilling et al.

(10) Patent No.: US 6,202,785 B1
(45) Date of Patent: Mar. 20, 2001

(54) MUFFLER WITH ACOUSTIC ABSORPTION INSERT FOR LIMITED CLEARANCE PNEUMATIC DEVICE APPLICATIONS

(75) Inventors: George D. G. Hilling, Roseville; Russell E. Blette, Hastings; Kenneth F. Tredinnick, Vadnais Heights, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/323,790

(22) Filed: Jun. 2, 1999

(51) Int. Cl.[7] ..... F01N 1/24
(52) U.S. Cl. ..... 181/230; 181/256; 181/258
(58) Field of Search ..... 181/252, 256, 181/224, 230, 258

(56) References Cited

U.S. PATENT DOCUMENTS

| | | | | |
|---|---|---|---|---|
| 3,208,551 | | 9/1965 | Carls . | |
| 3,757,892 | | 9/1973 | Raudman, Jr. . | |
| 3,811,845 | | 5/1974 | Nakamura . | |
| 3,863,733 | | 2/1975 | Raudman, Jr. et al. . | |
| 3,884,037 | | 5/1975 | Barber et al. . | |
| 3,923,120 | | 12/1975 | Jatcko . | |
| 3,949,828 | | 4/1976 | Frochaux . | |
| 4,032,310 | | 6/1977 | Ignoffo . | |
| 4,082,160 | | 4/1978 | Schilling et al. . | |
| 4,228,868 | | 10/1980 | Raczuk . | |
| 4,324,314 | * | 4/1982 | Beach et al. | 181/230 |
| 4,368,799 | | 1/1983 | Wagner . | |
| 4,424,883 | | 1/1984 | Musiani . | |
| 4,487,290 | | 12/1984 | Flaherty . | |
| 4,580,657 | | 4/1986 | Schmeichel et al. . | |
| 4,598,790 | | 7/1986 | Uesugi et al. . | |
| 4,749,058 | | 6/1988 | Trainor . | |
| 5,166,479 | | 11/1992 | Gras et al. . | |
| 5,198,625 | | 3/1993 | Borla . | |
| 5,246,473 | | 9/1993 | Harris . | |
| 5,350,888 | | 9/1994 | Sager, Jr. et al. . | |
| 5,418,339 | | 5/1995 | Bowen et al. . | |
| 5,504,281 | | 4/1996 | Whitney et al. . | |
| 5,602,368 | | 2/1997 | Kaneso . | |
| 5,658,656 | | 8/1997 | Whitney et al. . | |
| 5,661,272 | | 8/1997 | Iannetti . | |
| 5,767,459 | | 6/1998 | Sell . | |
| 5,777,947 | | 7/1998 | Ahuja . | |
| 5,783,782 | | 7/1998 | Sterrett et al. . | |
| 5,813,180 | | 9/1998 | Whitney et al. . | |

FOREIGN PATENT DOCUMENTS

| | | |
|---|---|---|
| 1432048 | 4/1976 | (GB) . |
| WO 90/14146 | 11/1990 | (WO) . |

OTHER PUBLICATIONS

Catalog 105, McMaster–Carr Supply Company, pp. 220–221, Chicago, Illinois, ©1999.
Brochure entitled "Pneumatic Mufflers for many pumps, motors, other air–operated equipment", by 3M, ©1997.
Brochure entitled "Pneumatic Muffler for many pumps, other air–operated equipment", by 3M, ©1998.

* cited by examiner

*Primary Examiner*—Khanh Dang
(74) *Attorney, Agent, or Firm*—Lisa M. McGeehan

(57) ABSTRACT

A muffler for attenuating noise produced by a pneumatic device having limited clearance. The muffler includes a housing, a base and an acoustic absorption insert. The housing defines an upstream end and a downstream end, with the downstream end being closed. Further, the housing tapers from a maximum width of less than approximately 1.5 inches (38 mm) to the downstream end. The base is secured to the housing at the upstream end and includes a tube for directing airflow and sound waves into the housing. Finally, the acoustic absorption insert is disposed within the housing and includes a web of fibers configured to absorb sound waves. The muffler can be utilized with a pneumatic valve having limited space available for receiving the muffler, providing noise attenuation with minimal back pressure.

46 Claims, 5 Drawing Sheets

MUFFLER WITH ACOUSTIC ABSORPTION INSERT FOR LIMITED CLEARANCE PNEUMATIC DEVICE APPLICATIONS

BACKGROUND OF THE INVENTION

The present invention concerns a muffler for attenuating noise produced by a pneumatic device. More particularly, it relates to a reduced-sized muffler incorporating an acoustic absorption insert for use with a pneumatic device having limited available area for muffler placement.

A wide variety of different devices are pneumatically controlled and/or actuated. Such devices include processing equipment incorporating one or more pneumatic valve banks, pneumatic robotic applications, pneumatic testing equipment, hand-held pneumatic tools, pumps, etc. Basically, flow of a pressurized fluid, normally air, is used to actuate or maneuver a mechanism, such as a linkage arm, resulting in a desired output. Depending upon the particular application, one or more pneumatic valves are typically utilized to direct the forced air to a desired location within the device, as well as to release the air through an exhaust port. Because the air is pressurized and the exhaust port relatively small, the exhausted air is normally traveling at a high velocity. As the high velocity air flows into relatively still air, the airflow becomes turbulent. Eddies associated with the now turbulent airflow generate pressure fluctuations, resulting in exhaust noise.

Depending upon the particular application, the exhaust noise may rise to an unacceptable level, potentially leading to noise-induced hearing loss. As a point of reference, United States standards require hearing protection for individuals exposed to continuous noise levels in excess of 85 decibels (dB) over an 8-hour period. International standards require hearing protection for noise levels in excess of 80 dB over an 8-hour period. Notably, exhaust noise at less than 80 dB, or intermittent noise at levels greater than 80 dB, can be equally irritating and harmful.

Various techniques can be employed to minimize the effect of exhaust noise produced by a pneumatic device. For example, an individual working in close proximity to the device may be provided with hearing protection. Unfortunately, the operator may forget to wear the hearing protection, or may simply choose not to use it due to perceived inconveniences. Additionally, other nearby workers or visitors who do not wear hearing protection will be subjected to the same noise-related concerns. Alternatively, a sound barrier or enclosure may be placed about the device. In many instances, however, this approach is not viable from both a cost standpoint and because an external barrier may unduly impede proper device operation. A third, more practical approach is to connect a muffler or silencer to the exhaust port.

Generally speaking, pneumatic device-related mufflers attenuate noise by presenting a barrier to airflow, absorbing sound waves, or both. For most commercial applications, a typical pneumatic muffler includes a cylindrical housing configured for mounting to the exhaust port. The housing defines one or more internal chambers through which air from the exhaust port is directed. Further, an airflow barrier and/or sound absorption insert is normally disposed within the housing. Finally, the housing normally forms one or more airflow passages or apertures through which air is released (or exhausted) from the muffler. A wide variety of materials are available for use as the insert, ranging from metals and cloth to composite materials. For example, various pneumatic muffler products are available from Minnesota Mining & Manufacturing Company of St. Paul, Minn. that make use of a replaceable acoustic barrier insert.

Regardless of the exact configuration, two important parameters must be considered when assessing pneumatic muffler performance. First, the muffler must limit exhaust noise to an acceptable level. Additionally, any back pressure caused by the muffler must be accounted for. In simplest terms, a portion of the total system pressure is required to push a given airflow through the muffler. This pressure is referred to as the "back pressure" of the muffler. Depending upon the particular application and level of back pressure, overall performance of the pneumatic device may be greatly diminished.

It is well known that noise attenuation and back pressure minimization are inversely related. That is to say, the noise reduction characteristic of a particular pneumatic muffler may be enhanced by incorporating additional, or a more dense, insert material. However, this additional material or material density will likely increase back pressure, thereby diminishing muffler usefulness. With this relationship in mind, noise attenuation and back pressure can be optimized by designing the muffler housing and associated insert material to be relatively large. For example, most commercially available pneumatic mufflers have a length in the range of 4–8 inches (102–203 mm) and an outer diameter in the range of 1.5–4 inches (38–102 mm). To maximize airflow from the muffler (and therefore minimize back pressure), the pneumatic muffler housing typically includes a series of circumferential slots along the housing side wall. Thus, the housing itself normally serves as only a partial barrier to airflow and sound waves.

Pneumatic mufflers adhering to the above-described dimensional characteristics have proven to be highly effective in attenuating pneumatic exhaust noise with minimal back pressure. Unfortunately, however, certain pneumatic device applications do not provide sufficient clearance for mounting of these relatively large mufflers. For example, certain types of processing equipment (e.g., a mail sorter) include a valve bank incorporating a large number of pneumatic valves (and thus exhaust ports) positioned in close proximity to one another. Often times, the valve exhaust ports have a center-to-center spacing of less than 1.5 inches (38 mm). Obviously, the above-described "standard" muffler sizes prohibit their use with these limited clearance applications, as it is impossible to mount two of the mufflers side-by-side. Further, where the muffler housing is relatively long and extends an appreciable distance from the pneumatic device, the opportunity for an operator to inadvertently contact and possibly break or otherwise damage the muffler becomes increasingly prevalent.

Efforts have been made to overcome the clearance problems associated with closely spaced pneumatic valve exhaust ports. For example, tubing can be connected to each of the exhaust ports and then routed to a single muffler at a location spaced from the exhaust ports. This technique is expensive and time consuming, and likely results in prohibitive back pressure. Alternatively, attempts have been made to produce a reduced-sized cylindrical muffler housing containing a barrier material such as sintered brass or felt. While a series of these so-configured mufflers can be mounted side-by-side to a confined clearance valve bank, the necessarily small volume of selected insert material associated with each of the individual mufflers cannot alter airflow and/or absorb noise to provide sufficient noise reduction. Of particular concern are relatively continuous valve cycling applications. Often times, these devices require a relatively small noise reduction (e.g., in the range of 5 dB for an open exhaust noise level of 90 dB) per exhaust port, but are highly sensitive to back pressure. The commercially available, reduced-sized mufflers may provide for potentially acceptable noise reduction, but may generate an extremely high back pressure, and therefore cannot be used.

Mufflers for use in attenuating noise produced by pneumatic devices continue to be extremely popular. However, where the particular pneumatic device has very limited clearance space for receiving the muffler, "standard" sized mufflers cannot be used. Efforts to design a viable, reduced-sized pneumatic muffler have been unavailing. Therefore, a need exists for a pneumatic muffler having acceptable noise reduction and back pressure characteristics that is sized for use with restricted clearance space applications.

SUMMARY OF THE INVENTION

One aspect of the present invention relates to a muffler for attenuating noise produced at an exhaust port of a pneumatic device. The muffler comprises a housing, a base and an acoustic absorption insert. The housing defines an upstream end and a downstream end. The downstream end is closed. Further, at least a portion of the housing tapers in diameter to the downstream end. The base is secured to the housing at the upstream end and includes a tube for directing air from the exhaust port into the housing. Finally, the acoustic absorption insert is disposed within the housing. The insert includes a web of fibers configured to absorb sound waves.

Prior to use, the muffler is mounted to the pneumatic device such that the tube is in fluid communication with the exhaust port. Pressurized air and sound waves are directed from the exhaust port, via the tube, into the housing. More particularly, the airflow and sound waves interact with the acoustic absorption insert. The acoustic absorption insert absorbs at least a portion of sound waves. In this regard, the tapered configuration of the housing enhances interaction of the sound waves with the insert material, and promotes sound wave phase cancellation, thereby further reducing noise. Notably, the acoustic absorption insert in combination with the tapered shape of the housing generates minimal back pressure.

Another aspect of the present invention relates to a muffler for attenuating noise produced at an exhaust port of a pneumatic device. The muffler includes a housing, a base and an acoustic absorption insert. The housing defines an upstream end and a downstream end, with the downstream end being closed. Further, the housing has a maximum width of less than 1.5 inches (38 mm). In one preferred embodiment, for example, the housing is circular in transverse cross-section, and therefore has a maximum diameter of less than 1.5 inches (38 mm). The base is secured to the housing at the upstream end and includes a tube for directing air from the exhaust port into the housing. Finally, the acoustic absorption insert is disposed within the housing. The insert material includes a web of fibers configured to absorb sound waves.

Prior to use, the muffler is mounted to the pneumatic device such that the tube is in fluid communication with the exhaust port. The limited maximum diameter of the housing facilitates the muffler being mounted in a confined area. Further, a series of similarly configured mufflers can be mounted side-by-side to a pneumatic valve bank having closely spaced exhaust ports. Air and sound waves entering the muffler are directed into contact with the acoustic absorption insert. The acoustic absorption insert absorbs a portion of the sound waves, thereby limiting noise that would otherwise be generated at the exhaust port with minimal back pressure.

Yet another aspect of the present invention relates to a muffler for attenuating noise produced at an exhaust port of a pneumatic device. The muffler includes a housing, a base and an acoustic absorption insert. The housing defines an upstream end and a downstream end, the downstream end being closed. Further, the housing tapers from a maximum width of less than 1.5 inches (38 mm) at the upstream end to the downstream end. In one preferred embodiment, for example, the housing is circular in transverse cross-section, and therefore has a maximum diameter of less than 1.5 inches (38 mm). The base is secured to the housing at the upstream end and includes a tube for directing air from the exhaust port into the housing. Finally, the acoustic absorption insert is disposed within the housing. The insert includes a web of fibers configured to absorb sound waves. Due to the relatively small diameter of the housing, the muffler can be mounted to a pneumatic device having limited muffler clearance. Following assembly to the pneumatic device, the tube directs air and sound waves from the exhaust port into contact with the acoustic absorption insert within the housing. The acoustic absorption insert, in turn, absorbs at least a portion of the sound waves. In this regard, the tapered shape of the housing facilitates sound wave cancellation and increased interaction of the sound waves with the acoustic absorption insert.

DETAILED DESCRIPTION OF THE PREFERRED EMBODIMENTS

Figure 1:
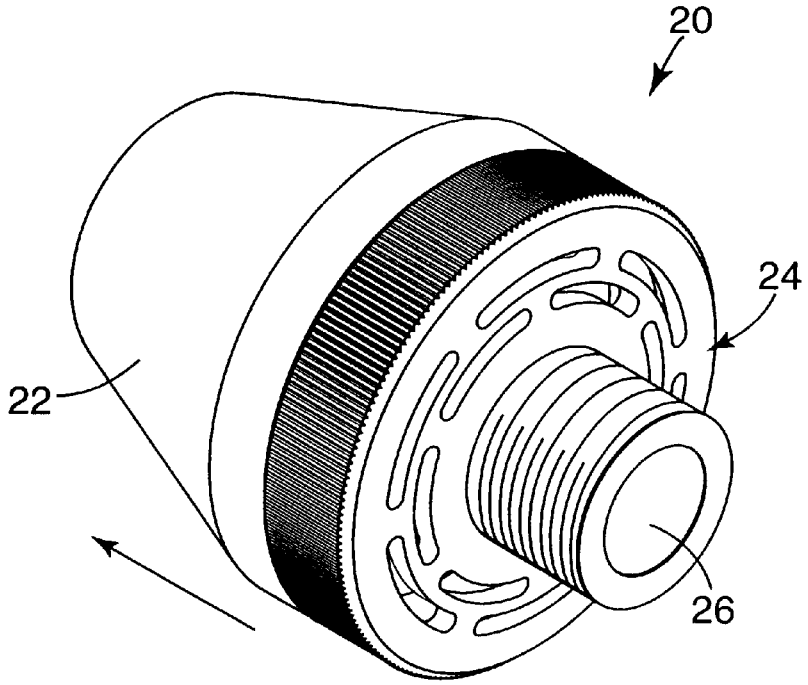
FIG. 1 is a perspective view of a muffler in accordance with the present invention.

One preferred embodiment of a muffler 20 is shown in FIG. 1. The muffler 20 includes a housing 22, a base 24 and an acoustic absorption insert (not shown). In general terms, the base 24 is secured to the housing 22. Further, the acoustic absorption insert is disposed within the housing 22. As a point of reference, upon final assembly, air enters the muffler 20 at a tube 26 formed in the base 24, flowing into the housing 22. With this general airflow direction in mind (represented by an arrow in FIG. 1), various components of the muffler 20 will be referenced throughout this specification as being "upstream" or "downstream" of one another. It will be understood that this directional terminology is used for purposes of illustration only, and is in no way limiting. Pointedly, as described below, in one preferred embodiment, following passage through the tube 26, airflow will, in fact, be deflected or otherwise directed by the housing 22 in a direction generally opposite that of the arrow in FIG. 1.

Figure 2:
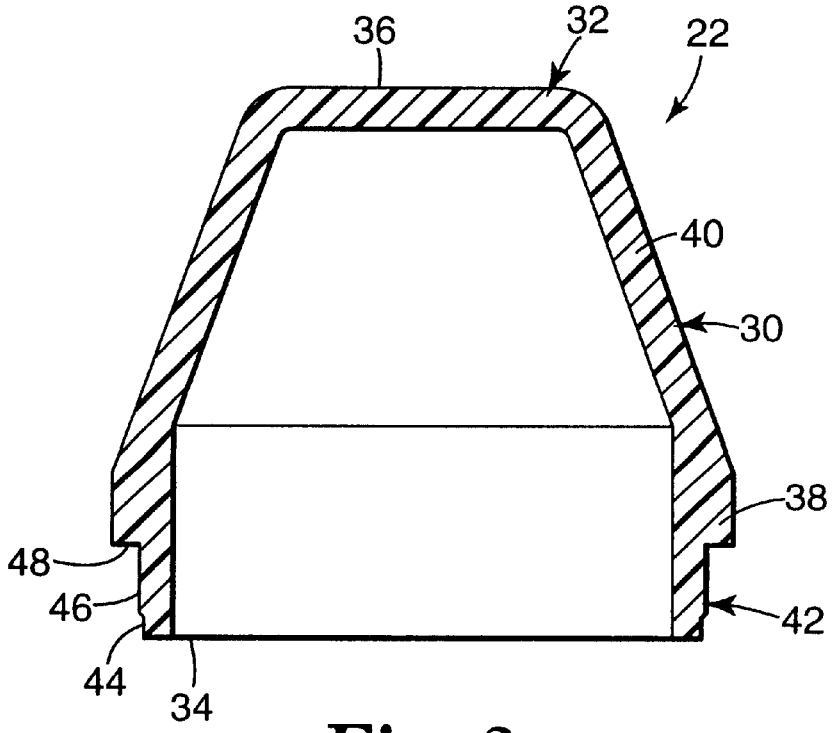
FIG. 2 is an enlarged, cross-sectional view of a housing portion of the muffler of FIG. 1.

The housing 22 is shown in greater detail in FIG. 2. The housing 22 includes a side wall 30 and an end wall 32 that combine to define an upstream end 34 and a downstream end 36. As shown in FIG. 2, the upstream end 34, as defined by the side wall 30, is preferably open. Conversely, the downstream end 36, formed by the end wall 32, is preferably closed.

The side wall 30 is preferably continuous. That is to say, the side wall 30 does not form ports or other airflow passages (other than the upstream end 34). Thus, the side wall 30 serves as a substantially complete barrier to airflow and sound waves.

In a preferred embodiment, at least a portion of the side wall 30 is frusto-conical. For example, as shown in FIG. 2, the side wall 30 can be defined by a first section 38 that is substantially cylindrical and a second section 40 that is substantially frusto-conical. More particularly, the second section 40 extends in a downstream fashion from the first section 38, tapering in diameter to the end wall 32. With respect to the longitudinal cross-sectional view shown in FIG. 2, a taper of the side wall 30 at the second section 40 forms an included angle in the range of approximately 20°–70°; more preferably 30°–50°; most preferably 40°. While the housing 22 is described as preferably being cylindrical and/or frusto-conical (and thus circular in transverse cross-section), other shapes are acceptable. For example, the housing 22 may be triangular, square, octagonal, etc. in transverse cross-section.

Finally, the side wall 30 is preferably configured for attachment to the base 24 (FIG. 1). For example, in one preferred embodiment, the side wall 30, and in particular the first section 38, forms a receiving area 42 adjacent the upstream end 34. The receiving area 42 includes a guide surface 44, an engagement surface 46 and a radial stop 48. The guide surface 44 has a diameter slightly less than a corresponding portion of the base 24, as described in greater detail below, and preferably tapers to facilitate mounting to the base 24. The engagement surface 46 is sized to frictionally receive a portion of the base 24. Finally, the radial stop 48 is sized to positively position the base 24. Alternatively, other engagement techniques may be employed such that the receiving area 42 is configured to be substantially linear. Even further, the receiving area 42 may be eliminated entirely where alternative mounting arrangements, such as an adhesive for example, are utilized.

The end wall 32 is preferably relatively flat (as shown in FIG. 2) for ease of manufacture. Alternatively, the end wall 32 may assume other configurations. For example, the end wall 32 may be hemispherical or other domed configuration. Regardless of the exact shape, the end wall 32 is preferably closed such that it does not form any airflow passages or apertures. Thus, the end wall 32 presents a substantially complete barrier to airflow and sound waves.

The various sections of the housing 22 are preferably integrally formed from a relatively rigid material. For example, in one preferred embodiment, the housing 22 is a molded polymer, preferably polyamide (nylon 6, 6, 33% by weight glass reinforced). Alternatively, other polymers such as polypropylene may be useful. Essentially, the housing 22 can be any moldable or machinable material such as, for example, a ceramic, steel or aluminum, and combinations or composites thereof.

Taken as a whole, the housing 22 is preferably sized for use with a pneumatic device having a limited muffler footprint or clearance. More particularly, the housing 22 has a maximum width (defined by an outer width of the side wall 30) that is less than 1.5 inches (38 mm); more preferably less than 1 inch (25 mm). With reference to one preferred embodiment, the housing is circular in transverse cross-section such that the maximum width is a diameter (defined by an outer diameter of the side wall 30 at the first section 38) less than 1.5 inches (38 mm); more preferably less than 1 inch (25 mm). For example, in one preferred embodiment, the housing 22 has an outer diameter of 0.96 inch (24.4 mm) at the first section 38 downstream of the radial stop 48. Further, an inner surface of the side wall 30 is preferably relatively uniform at each of the first section 38 and the second section 40 (as shown by the cross-sectional view of FIG. 2). With this in mind, the side wall 30 at the first section 38 preferably has an inner width (preferably a diameter) in the range of approximately 0.5–1.0 inch (12.7–25 mm); more preferably about 0.65–0.85 inch (16.5–21.6 mm). For example, in one preferred embodiment, the side wall 30 has an inner diameter of 0.78 inch (19.8 mm) at the first section 38.

An additional feature of the housing 22 is a wall thickness. To facilitate mounting to the base 24 (FIG. 1), the first section 38 of the side wall 30 preferably has a varying thickness. However, the thickness of the side wall 30 at the second section 40 is relatively uniform, in the range of approximately 0.03–0.09 inch (0.76–2.29 mm); more preferably about 0.05–0.07 inch (1.27–1.78 mm); most preferably 0.06 inch (1.52 mm). The end wall 32 is preferably constructed to an identical thickness range. With a properly selected material for the housing 22, the above thickness parameters result in the housing 22 being a substantial barrier to airflow and sound waves. Thus, in one preferred embodiment, an essentially complete airflow/sound wave barrier is presented by a housing constructed of polyamide with a wall thickness of 0.06 inch (1.52 mm).

Figure 3A:
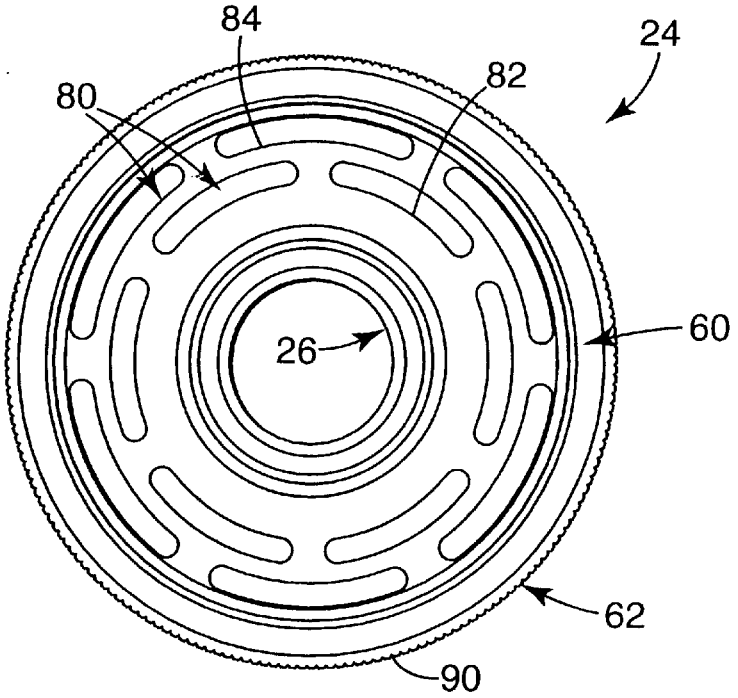
FIG. 3A is an enlarged, end view of a base portion of the muffler of FIG. 1.
Figure 3B:
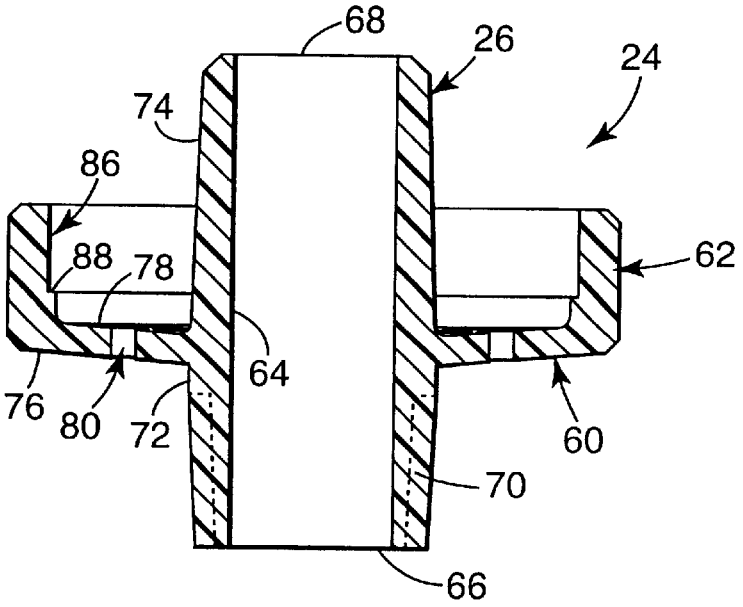
FIG. 3B is an enlarged, cross-sectional view of the base of FIG. 3A, along the line B—B.

The base 24 is shown in greater detail in FIGS. 3A and 3B. The base 24 includes the tube 26, an inlet wall 60 and an annular flange 62. The tube 26 is centrally positional relative to the inlet wall 60, with the inlet wall 60 extending in a generally radial fashion. The annular flange 62 extends from the inlet wall 60 opposite the tube 26.

The tube 26 is preferably substantially cylindrical and defines a passage 64 extending from an inlet end 66 to an outlet end 68. Further, the tube 26 is preferably configured for mounting to a pneumatic device exhaust port (not shown). Thus, in one preferred embodiment, the tube 26 forms exterior threads 70 adjacent the inlet end 66. Alternatively, other mounting techniques and related designs may be incorporated. With the preferred exterior threads 70, however, the inlet end 66 is sized in accordance with a "standard" exhaust port size. Thus, for example, the inlet end 66 has an outer diameter corresponding with a ⅛ inch National Pipe Taper (NPT) exhaust port. Alternatively, the inlet end 66 may be sized to correspond with a ¼ inch NPT, ⅜ inch NPT, ½ inch NPT, ¾ inch NPT or 1 inch NPT. Even further, where the exhaust port implements a mounting design other than National Pipe Taper (e.g., non-tapered), the inlet end 66 will preferably assume a corresponding configuration.

The relationship of the tube 26 relative to the inlet wall 60 and the housing 22 (FIG. 2) upon final assembly is described in greater detail below. In one preferred embodiment, however, the tube has a length (defined as a distance from the inlet end 66 to the outlet end 68) in the range of approximately 0.6–1.0 inch (15.2–25.4 mm); more preferably about 0.7–0.9 inch (17.8–22.9 mm). For example, in one preferred embodiment, the tube 26 has a length of about 0.81 inch (20.6 mm).

The tube 26, and in particular the passage 64, is configured to direct airflow and sound waves from the exhaust port (not shown) to a point downstream of the inlet wall 60. Thus, the tube 26 can be defined with respect to the inlet wall 60 as having an upstream portion 72 and a downstream portion 74. The upstream portion 72 is located upstream of the inlet wall 60; whereas the downstream portion 74 is downstream of the inlet wall 60. As shown in FIG. 3B, the passage 64 at the downstream portion 74 is preferably cylindrical. Alternatively, other configurations may also be useful to effectuate a desired airflow distribution. For example, the passage 64 at the downstream portion 74 may be frusto-conical, increasing or tapering in diameter.

The inlet wall 60 extends in a generally radial fashion from the tube 26 and defines an exterior face 76 and an interior face 78. As best shown in FIG. 3A, the inlet wall 60 forms a plurality of slots or airflow passages 80, each extending from the interior face 78 to the exterior face 76. In one preferred embodiment, each of the plurality of slots 80 are arcuate in shape, having a radial width in the range of approximately 0.02–0.06 inch (0.5–1.5 mm), most preferably about 0.04 inch (1 mm), and an arc length in the range of approximately 40°–60°, most preferably about 50°. Preferably, a first series 82 of the plurality of slots 80 are arranged at a first diameter of the inlet wall 60, and a second series 84 at a second diameter. Alternatively, any other number, size, shape and location may be employed for the plurality of slots 80. It will be understood, however, that at least one slot (or airflow passage) is preferably provided and that the final configuration promotes maximum airflow through the inlet wall 60 while maintaining sufficient structural integrity of the base 24.

The annular flange 62 extends in a downstream fashion from the interior face 78 of the inlet wall 60 and is configured for mounting to the housing 22 (FIG. 2) as previously described. Thus, in one preferred embodiment, an inner surface 86 of the annular flange 62 forms a shoulder 88 positioned to receive the upstream end 34 (FIG. 2) of the housing 22. Further, the inner surface 86 has a diameter approximating a diameter of the engagement surface 46 (FIG. 2) of the housing 22 to facilitate a frictional fit. Finally, an outer surface 90 of the annular flange 62 is preferably knurled as best shown in FIG. 3A to improve handling of the base 24 by a user. Alternatively, the outer surface 90 may be flat.

The various sections of the base 24 are preferably integrally formed from a relatively rigid material. For example, in one preferred embodiment, the base 24 is formed from a material identical to that of the housing 22 and thus is a molded polymer, such as polyamide (nylon 6, 6, 33% by weight glass reinforced). Alternatively, other polymers such as polypropylene may be useful. Essentially, the base 24 can be any moldable or machinable material such as, for example, a ceramic, steel or aluminum, and combinations or compositions thereof.

As set forth below, a downstream extension of the tube 26 relative to the inlet wall 60 is directly related to a desired position of the outlet end 68 within the housing 22 (FIG. 2) upon final assembly. However, certain dimensional characteristics of the tube 26 relative to the inlet wall 60 can be described with reference to FIG. 3B. More particularly, the downstream portion 74 of the tube 26 (e.g., extension of the tube 26 from the inner surface 86 to the outlet end 68) is preferably in the range of approximately 0.3–0.7 inch (7.6–17.8 mm); more preferably in the range of approximately 0.35–0.55 inch (8.9–14 mm). For example, in one preferred embodiment, the downstream portion 74 has a length of about 0.46 inch (11.7 mm).

Figure 4:
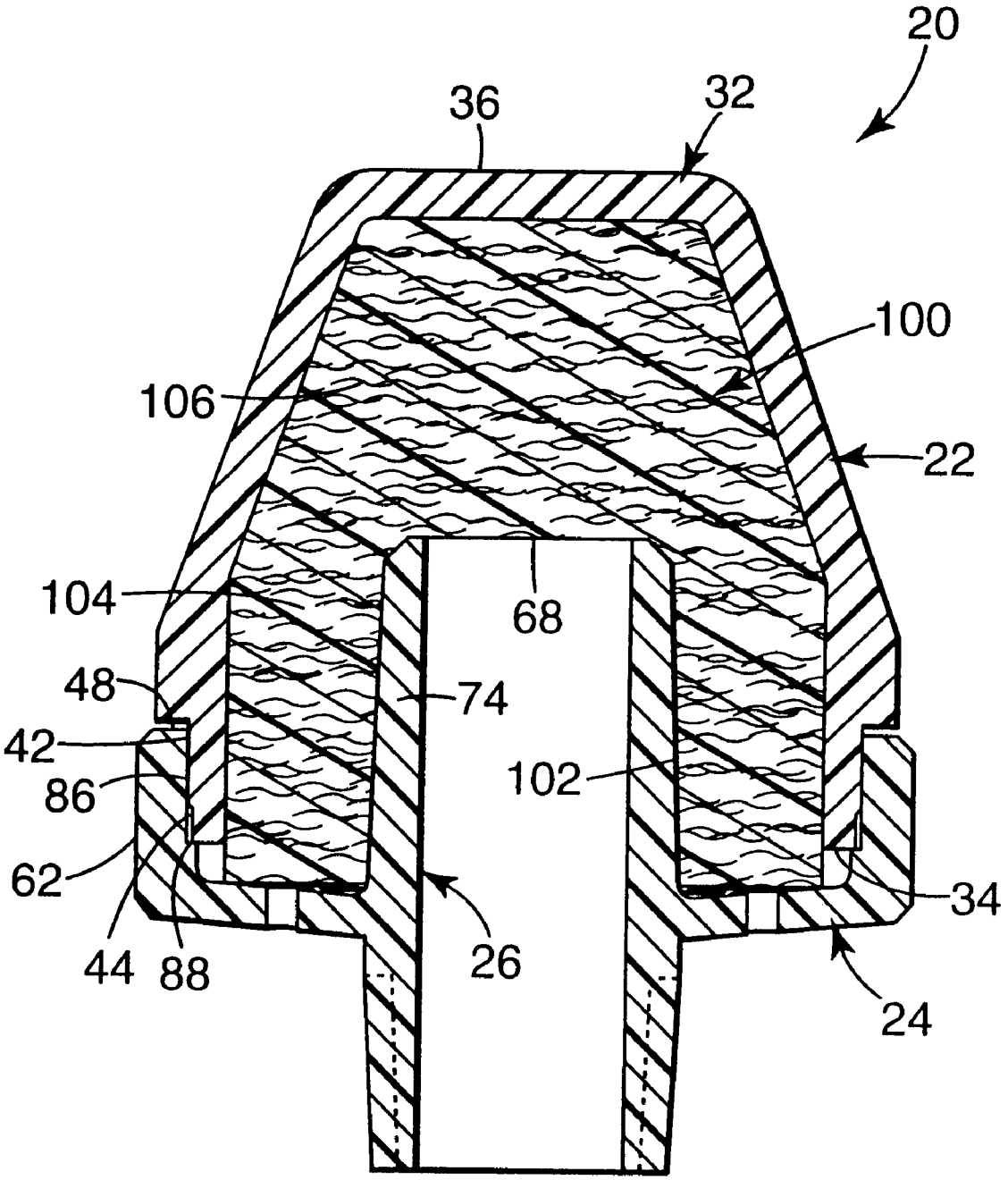
FIG. 4 is an enlarged, cross-sectional view of the muffler of FIG. 1.

The muffler 20, and in particular the acoustic absorption insert 100, is shown in greater detail in FIG. 4. The acoustic absorption insert 100 is disposed within the housing 22, and is positioned about the tube 26. The acoustic absorption insert 100 preferably conforms generally with the tapered shape of the housing 22, extending across the outlet end 68 of the tube 26. That is to say, the acoustic absorption insert 100 encompasses a portion of an available volume, preferably all of the available volume, of the housing 22 downstream of the tube 26. Thus, as described in greater detail below, airflow and sound waves from the tube 26 are directed from the outlet end 68 directly into the acoustic absorption insert 100.

The acoustic absorption insert 100 is preferably a non-woven web constructed of fibers and a binding resin, and is commonly referred to as a "blown microfiber". With this configuration, the acoustic absorption insert 100 serves to absorb sound waves.

The fibers usefull according to the invention can be synthetic and/or natural polymeric fibers. Examples of useful synthetic polymeric fibers include, but are not limited to, those selected from a group consisting of polyester resins, such as polyester, polyethylene (terephthalate) and polybutylene (terephthalate), polyamide resins such as nylon, and polyolefin resins such as polypropylene and polyethylene, and blends thereof. Examples of useful natural polymeric fibers include, but are not limited to, those selected from a group consisting of wool, silk, cotton and cellulose. The fibers should have a diameter in the range of approximately 30 micrometers to about 150 micrometers, and preferably, in the range of about 35–100 micrometers. The fibers can have diameters less than 30 micrometers if they are capable of being twisted or otherwise formed together to form a larger diameter fiber. Although fiber length is not particularly critical, suitable fibers typically range in length from about 30 mm to about 100 mm, and are preferably about 35–50 mm in length for ease in web formation. Blends of fibers of varying lengths and diameters can be used for the non-woven web. Finally, the fibers preferably have a fineness characteristic in the range of approximately 5–50 denier.

Useful fibers also include, but are not limited to, melt bondable fibers that can be of the sheath-core type wherein the core of the fiber is a polymer having a relatively high melting temperature compared to the surrounding sheath polymer, such that in forming the web, the melting of the sheath causes it to flow to and bond to surrounding web fibers. Typically, the difference in melting point between the sheath and the core is about 10° C.–40° C., more typically 20° C.–40° C. difference. Examples of useful melt bondable fibers include, but are not limited to, those selected from the group consisting of polyester/polyester co-polymer blends, polyester/polypropylene fibers, and the like. Sheath core fibers are commercially available from sources such as Hoescht-Celanese, DuPont Company, and Eastman Kodak.

The non-woven web useful according to the present invention is coated or saturated with a binder resin that when cured will impart significant additional resistance to oils and moisture to the web. The binder resins also serve to stiffen the non-woven web so that it resists compression and use. These resins are generally thermoset polymeric compositions, and are selected to be resistant to oils and water. In one preferred embodiment, the binder is latex (styrene butadiene). Alternatively, suitable binder resins include, but are not limited to, those selected from the group consisting of phenolaldehyde resins, butylated urea aldehyde resins, epoxide resins, polyester resins (such as the condensation product of maleic and phthalic anhydrides, and propylene glycol), acrylic resins, styrene-butadiene resins, plasticized vinyl, polyurethanes, and mixtures thereof. The binder resins can further include fillers such as talc, silica, calcium carbonate, and the like to enhance the stiffness of the web. The binder resins can be provided in a water emulsion or latex, or in an organic solvent.

Sufficient binder resin is added to hold the fibers in place without becoming overly stiff. The amount of binder resin useful in the practice of the invention is typically about 100–400 parts by weight of dry resin per 100 parts by weight of non-woven web. Preferably, the binder resin is used in an amount of 130–230 parts by weight per 100 parts of non-woven web for optimal compression and acoustic performance.

The non-woven web can optionally include a saturant coating of a viscoelastic composition to enhance sound attenuation properties. Useful viscoelastic materials include oil and water resistant viscoelastic damping polymers such as polyacrylates, styrene butadiene rubbers, silicone rubbers, urethane rubbers, nitrile rubbers, butyl rubbers, acrylic rubbers, and natural rubbers and acrylic-based viscoelastic material such as 3M Viscoelastic Damping Polymers ISD110, ISD112 and ISD113 (available from Minnesota Mining & Manufacturing Company of St. Paul, Minn.). The polymers may be dispersed into a suitable solvent and coated onto the non-woven structure. The polymer solution typically has 1%–7% polymer solids by weight and preferably is a 2%–5% solids solution. The polymer should be stable at the use temperature of the pneumatic device which typically ranges from about −40° C. to about 50° C., more typically about 5° C.–40° C. The polymer has a loss factor greater than about 0.2, preferably greater than 0.5, most preferably greater than 0.8 at the use temperature (21° C. for example).

Examples of acceptable web constructions for the acoustic absorption insert 100 are described in U.S. Pat. No. 5,418,339, the teachings of which are incorporated herein by reference.

To facilitate placement about the tube 26, the acoustic composite insert 100 preferably forms a core passage 102. The core passage 102 is sized to approximate an outer diameter of the tube 26 at the downstream portion 74. To this end, in one preferred embodiment, the acoustic absorption insert 100 is slightly deformable. With this configuration, the core passage 102 may initially have a diameter slightly less than that of the tube 26, but will deform to a slightly greater diameter upon insertion over the tube 26.

With reference to FIG. 4, the muffler 20 is assembled substantially as follows. The acoustic absorption insert 100 is formed to correspond generally with the size and shape of the housing 22. For example, the acoustic absorption insert 100 may be cut from a bulk supply of appropriate web material. The core passage 102 is then formed. In this regard, the acoustic composite insert 100 can be formed as a unitary body, whereby the core passage 102 extends partially through the singular body. Alternatively, the acoustic absorption insert 100 can be formed as two separate parts. The first or upstream part (shown generally at 104 in FIG. 4) has a height corresponding with the downstream portion 74 of the tube 26. Thus, the core passage 102 will pass entirely through the upstream part 104. Additionally, a second or downstream part 106 is provided. The downstream part 106 essentially is a frusto-conical shaped disc, with no central passage. Thus, the downstream member 106 extends across the outlet end 68 of the tube 26. With this approach, the downstream part 106 may initially be placed on top of the upstream part 104, over the tube 26. Alternatively, the downstream part 106 may be inserted within the housing 22, abutting the end wall 32.

With either insertion approach, it is possible to optimize the amount of the acoustic absorption insert 100 within the housing 22. More particularly, due to the acoustic absorption insert 100 preferably being deformable/compressible, the amount (e.g., mass) of material placed within the housing can be increased or decreased, yet the resulting acoustic absorption insert 100 will still fill an available volume within the housing 22 (exclusive of the volume occupied by the tube 26). In this regard, the actual amount of material comprising the acoustic absorption insert 100 dictates muffler performance, as described in greater detail elsewhere. In general terms, however, decreasing the amount (or mass) of material comprising the acoustic absorption insert 100 may reduce the sound attenuation capabilities of the muffler 20. Conversely, adding more material may produce prohibitive back pressure. Notably, the "optimal" amount of material comprising the acoustic absorption insert 100 is a function of the web composition and the available internal volume within the housing. For example, for a housing 22 having an available internal volume (i.e., internal volume of the housing 22 minus the volume of the tube 26 within the housing 22) of about 0.5–2.0 $inch^3$ ($8\times10^3$–$33\times10^3$ $mm^3$), the acoustic absorption insert 100 preferably has a mass in the range of 0.25–1.0 gram, where 5–50 denier polyester fibers coated with styrene butadiene are used as the web material.

The housing 22 is then mounted to the base 24 as shown in FIG. 4. More particularly, the annular flange 62 is directed into contact with the receiving area 42 formed by the housing 22. The guide surface 44 facilitates placement of the housing 22 within the annular flange 62. In the one preferred embodiment, the inner surface 86 of the annular flange 62 frictionally engages the engagement surface 46 of the housing 22. The radial stop 48 contacts the annular flange 62, whereas the shoulder 88 abuts the upstream end 34 of the housing 22. Once properly positioned, the housing 22 and the base 24 are preferably sealed. For example, a sonic weld may be employed. Alternatively, other sealing techniques, such as an adhesive, may also be useful.

In the final assembled form, the tube 26 preferably extends centrally within the housing 22. In a preferred embodiment, the tube 26, and in particular the downstream portion 74, is configured such that the outlet end 68 is approximately equidistant between the upstream end 34 and the downstream end 36 of the housing 22. For example, in one preferred embodiment, the housing 22 has an internal height (defined as a distance from the upstream end 34 to an interior surface of the end wall 32) of 0.8 inch (20.3 mm), and the outlet end 68 extends within the housing 22 to a height of 0.39 inch (9.9 mm). Notably, the outlet end 68 need not be precisely equidistant between the upstream end 34 and the downstream end 36. Preferably, however, a relationship of the base 24 relative to the housing 22 is such that upon final assembly, the outlet end 68 of the tube 26 extends to a height in the range of approximately 25%–75% of a height of the housing 22; more preferably 40%–60% a height of the housing 22.

Upon final assembly, the housing 22 and the base 24 combine to define an overall length of the muffler 20 (or an overall height with reference to the orientation of FIG. 4). In this regard, a portion of the base 24, and in particular a portion of the tube 26, is preferably configured for placement within an exhaust port (not shown), with the remainder of the muffler 20 extending away from the exhaust port. Thus, the housing 22 and the base 24 combine to define an extension length of the muffler 20; in other words, a length of the muffler 20 extending outwardly from the exhaust port. With this definition in mind, the muffler 20 has an extension length that is preferably less than approximately 1.5 inches (38 mm); more preferably less than approximately 1 inch (25 mm).

Figure 5:
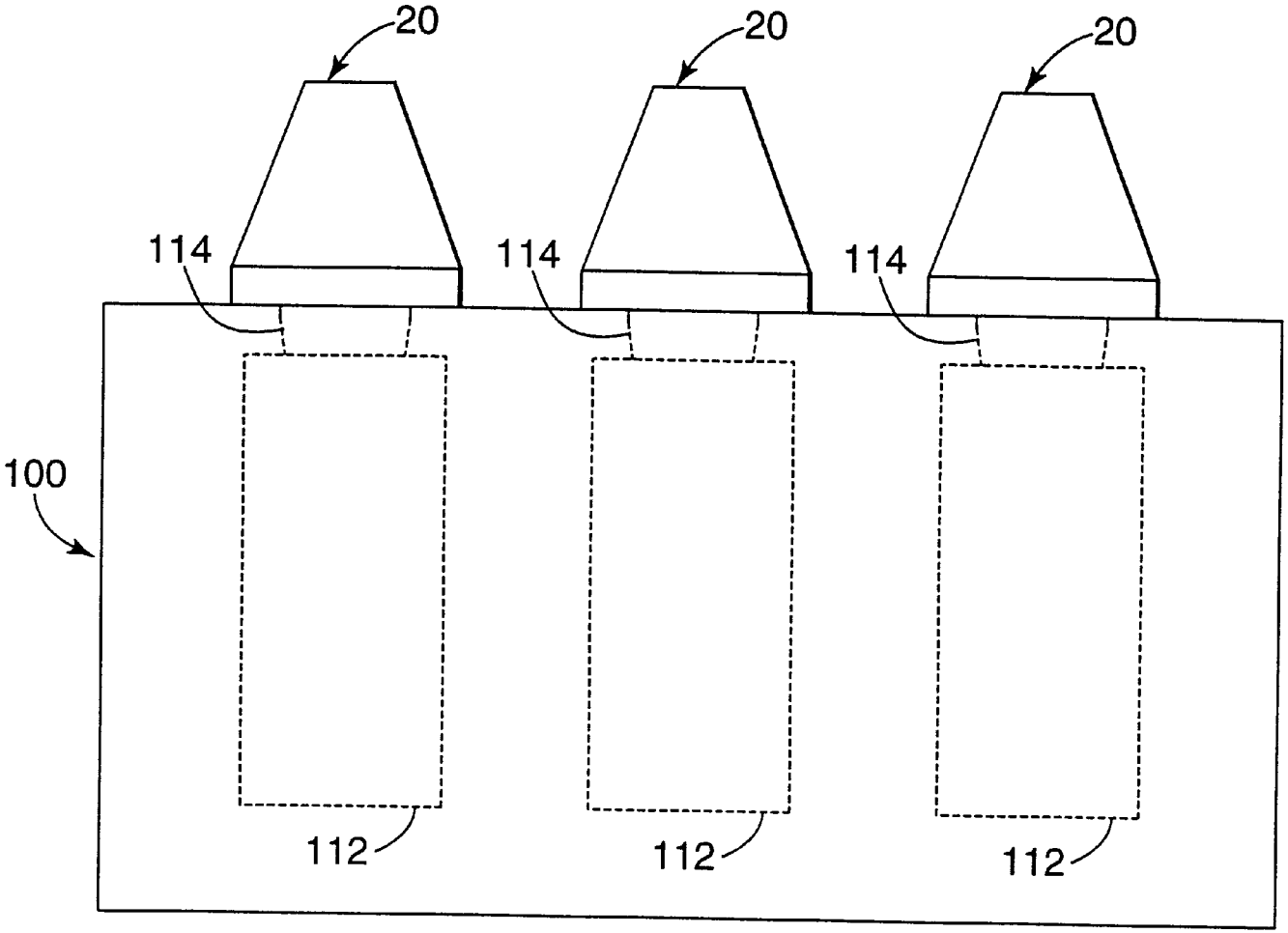
FIG. 5 is a side, elevational view of a pneumatic device incorporating mufflers in accordance with the present invention.

Following assembly, the muffler 20 is used to attenuate noise produced by a pneumatic valve. For example, FIG. 5 depicts a pneumatic valve bank 110. The valve bank 110 may be formed as part of an auxiliary device (not shown), such as a manufacturing and/or processing device or pneumatic robotic application. Alternatively, the muffler 20 may be used with a single valve associated with a pump or other pneumatic device. With respect to the application shown in FIG. 5, the valve bank 110 is shown as including three pneumatic valves 112 (shown generally in FIG. 5), each forming an exhaust port 114. In general terms, operation of the pneumatic valves 112 generates pressurized air exiting through the respective exhaust ports 114. If left open, the forced air exiting the exhaust port 114 would become highly turbulent, resulting in noise. This noise is attenuated by associating a muffler 20 in accordance with the present invention with each of the exhaust ports 114, respectively.

Prior to use, each of the mufflers 20 are mounted to a respective one of the exhaust ports 114. For example, with most pneumatic valve applications, each of the exhaust ports 114 are threaded. With reference to FIG. 3B, the tube 26 associated with each of the mufflers 20 includes the exterior thread 70 corresponding with the threads on the exhaust ports 104. Alternatively, a variety of other mounting techniques may be employed. Importantly, the pneumatic valves 112 associated with the valve bank 110 are depicted as being closely spaced to one another. This arrangement arises quite frequently with commercial applications whereby the pneumatic valves 112, and thus the exhaust ports 114, have a center-to-center spacing of less than 1.5 inches (38 mm). Under these confined clearance conditions, it is impossible to use "standard" mufflers due to their oversized housings. The muffler 20 of the present invention, however, can be used with limited clearance pneumatic valves 112, as the muffler 20 has a maximum width (preferably a maximum diameter) less than about 1.5 inches (38 mm). Further, because, as previously described, the muffler 20 preferably extends from the valve bank 110 to an extension length of less than approximately 1.5 inches (38 mm), the opportunity for inadvertent contact and damage is greatly reduced.

Figure 6:
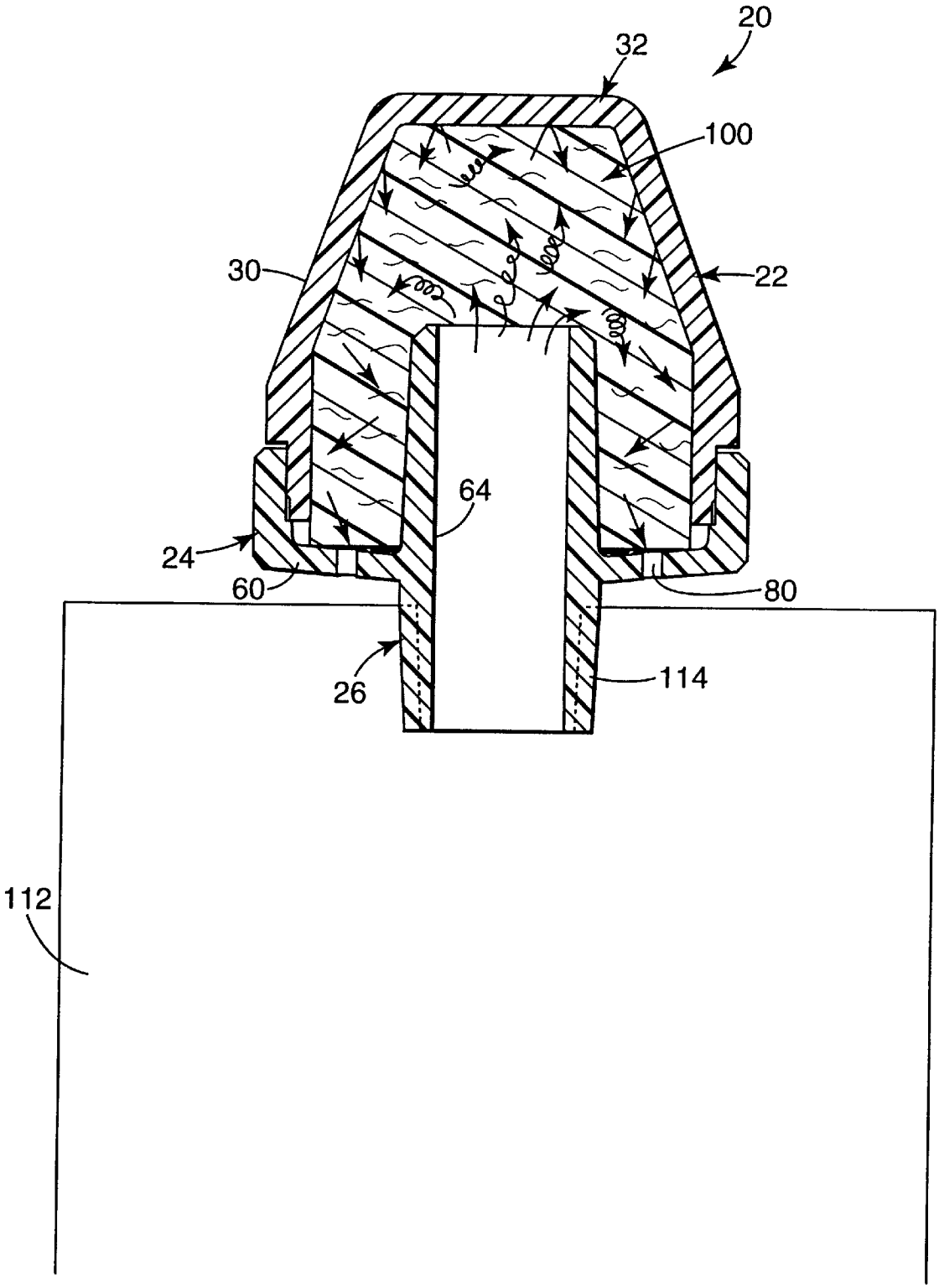
FIG. 6 is an enlarged, side, cross-sectional view of a portion of the device of FIG. 5 depicting airflow through a muffler.

Once secured to the valve bank 110, the mufflers 20 attenuate noise produced at the exhaust ports 114, respectively. An individual one of the mufflers 20 and a respective one of the pneumatic valves 112 is shown in greater detail in FIG. 6. The tube 26 is fluidly connected to the exhaust port 114 at the inlet end 66. Thus, airflow and associated sound waves enter the muffler 20 via the tube 26. The tube 26 serves as a sound barrier, thereby directing the airflow and sound waves (represented generally by arrows in FIG. 6), via the passage 64, into the housing 22. The airflow and sound waves exit the tube 26 at the outlet end 68, flowing into the acoustic absorption insert 100. As previously described, the acoustic absorption insert 100 is configured to absorb at least a portion of the sound waves. It is likely, however, that not all of the sound waves will be immediately absorbed. Instead, as shown by arrows in FIG. 6, the airflow and remaining sound waves flow in a generally downstream fashion through the acoustic absorption insert 100 and into contact with the housing 22, and in particular the side wall 30 and the end wall 32. As previously described, the side wall 30 and the end wall 32 are configured to serve as sound barriers. Thus, the remaining sound waves are deflected away from the side wall 30 and/or end wall 32, again into contact with the acoustic absorption insert 100. Once again, interaction of the sound waves with the acoustic absorption insert 100 results in a reduction in, or absorption of, sound waves. Further, at least a portion of the deflected sound waves will interact with other sounds waves, resulting in phase cancellations and therefore further sound attenuation. Over time, remaining sound waves will eventually deflect to the base 24, exiting the muffler 20 via the plurality of slots 80 in the inlet wall 60. Prior to exiting the muffler 20, however, a substantial portion of the sound waves will have been absorbed by the acoustic absorption insert 100 or have been eliminated via phase cancellation. Further sound attenuation (albeit minimal) may also be achieved via the acoustic absorption insert 100 presenting an airflow barrier, altering airflow to be less turbulent (i.e., more laminar).

In addition to achieving significant noise attenuation, the muffler 20 in accordance with the present invention generates minimal back pressure. First, the acoustic absorption insert 100 is highly porous, and therefore presents a marginal barrier to airflow. Additionally, the preferred tapered shape of the side wall 30 directs airflow toward the base 24, and thus the plurality of slots 80. In other words, the housing 22 is preferably configured to generally guide airflow directly to the plurality of slots 80 and thus out from the muffler 20.

The muffler 20 of the present invention provides significant noise attenuation. For example, with a pneumatic valve having an open exhaust port noise level in the range of approximately 50–100 dB, the muffler 20 will reduce pneumatic valve exhaust port noise by at least 5 dB; more preferably by at least 10 dB; most preferably by at least 15 dB. Importantly, the muffler 20 provides this noise attenuation while minimizing back pressure. To this end, an appropriate parameter indicative of back pressure is a cylinder recovery time of the pneumatic valve. Cylinder recovery time is a measure of the time required for the cylinder associated with the pneumatic valve to complete a single stroke. It should be understood that even with no back pressure (i.e., an open exhaust port), a cylinder recovery time will exist (e.g., is greater than 0). However, a change (or increase) in cylinder recovery time is a function of change (or increase) in back pressure in the system. Thus, for example, where a muffler is connected to a pneumatic valve device, any back pressure caused by the muffler will increase cylinder recovery time. With this in mind, at airflows in the range of 0–40 cfm (0–1,130 liters/minute) and cylinder recovery times of about 0.33 second, the muffler 20 causes an increase in cylinder recovery time of less than approximately 0.01 second. In other words, the muffler 20 preferably causes a degradation (or increase) in cylinder recovery time of less than about 5%. Thus, the muffler 20 is particularly applicable for use with relatively continuous flow pneumatic valve devices for which cylinder recovery time is a major concern.

The pneumatic muffler of the present invention provides a marked improvement over previous designs. The muffler is capable of being uniquely sized for use with a pneumatic valve having limited muffler clearance space. Unlike generally available pneumatic mufflers having diameters in excess of 3 inches (75 mm) and lengths in excess of 5 inches (127 mm), the muffler of the present invention is specifically designed so that it is capable of having both a maximum width and extension length less than approximately 1.5 inches (38 mm). With this greatly reduced size, the muffler can be used with valve exhaust ports having highly limited center-to-center clearance. Further, the muffler of the present invention preferably minimizes the opportunity for inadvertent operator contact and subsequent damage. Finally, unlike the few other reduced-sized mufflers currently available, the muffler of the present invention provides noise attenuation with virtually no back pressure.

EXAMPLES

The invention has been described with reference to various specific and preferred embodiments and will be further described by reference to the following detailed examples. It is understood, however, that there are many extensions, variations and modifications on the basic themes of the present invention beyond that shown in the examples and detailed description, which are in the spirit and scope of the present invention.

A muffler was prepared in accordance with the present invention and secured to an exhaust port of a pneumatic valve. The muffler was prepared from polyamide (nylon 6, 6 reinforced with 33% by weight of glass) and had the exterior dimensions of 1.33 inches (3.38 cm) height, and 1.00 inch (2.54 cm) base diameter. The inlet end of the muffler was ¼ inch NPT. The base and the housing were sonically welded together. The acoustical insert material used was 15 denier (nominal) latex coated polyester blown microfiber at different weights.

The pneumatic valve was then operated and various data measured. In particular, a Brüel & Kjaer Type 2144 Real Time Dual Channel frequency analyzer microphone was placed 24 inches (61 cm) and at a 45 degree angle from the muffler. Sound was measured as an impulse in a one second window. Additionally, the cylinder recovery time of the pneumatic valve was measured.

With the above parameters in mind, measurements were taken during operation of the pneumatic valve both with (Samples 1–15) and without (Comparative Sample 1, i.e., open exhaust port) a muffler of the present invention. The data represents an average of 3 readings, except for comparative Sample 1 which was an average of 12 readings. The following results were obtained:

| Sample | Wt. Of Acoustical Insert Material (g) | Sound Pressure Level (decibels) | Cylinder Recovery Time (seconds) |
|---|---|---|---|
| Comp. 1 | N/A | 96.4 | 0.3375 |
| 1 | 0.26 | 85.9 | 0.337 |
| 2 | 0.26 | 85.1 | 0.337 |
| 3 | 0.27 | 85.3 | 0.340 |
| 4 | 0.27 | 85.3 | 0.337 |
| 5 | 0.30 | 85.2 | 0.337 |
| 6 | 0.48 | 82.7 | 0.339 |
| 7 | 0.53 | 84.3 | 0.341 |
| 8 | 0.54 | 82.7 | 0.339 |
| 9 | 0.58 | 82.8 | 0.339 |
| 10 | 0.59 | 83.6 | 0.338 |
| 11 | 0.70 | 82.5 | 0.342 |
| 12 | 0.73 | 82.1 | 0.336 |
| 13 | 0.73 | 81.7 | 0.343 |
| 14 | 0.75 | 81.8 | 0.342 |
| 15 | 0.76 | 82.4 | 0.345 |

Although the present invention has been described with reference to preferred embodiments, workers skilled in the art will recognize that changes may be made in form and detail without departing from the spirit and scope of the present invention. For example, while the muffler has been described as incorporating a tapered housing, other configurations may be useful. For example, the housing may be a cylinder. Alternatively, the housing may have multiple diameter variations.

What is claimed is:

1. A muffler for attenuating noise produced at an exhaust port of a pneumatic device, the muffler comprising:

a housing defining an upstream end and a downstream end, the downstream end being closed, wherein at least a portion of the housing tapers in width to the downstream end;

a base secured to the housing at the upstream end, the base including an inlet tube for directing airflow and sound waves from the exhaust port into the housing; and an acoustic absorption insert disposed within the housing, the insert including a web of fibers configured to absorb sound waves;

wherein airflow in the housing is directed toward the base.

2. The muffler of claim 1, wherein the fibers comprise polyester.

3. A pneumatic valve device comprising:

a pneumatic valve forming an exhaust port; and a muffler in accordance with claim 1 fluidly connected to the exhaust port.

4. The pneumatic valve device of claim 3, wherein the housing has a maximum exterior width of less than 38 mm.

5. The pneumatic valve device of claim 3, wherein the housing and the base combine to define an extension length upon assembly to an exhaust port, the extension length being less than approximately 38 mm.

6. The pneumatic valve device of claim 3, wherein the housing includes a side wall, at least a portion of the side wall having a thickness in the range of approximately 0.76–2.3 mm.

7. The pneumatic valve device of claim 3, wherein the tube defines an inlet end and an outlet end, and further wherein upon final assembly, the outlet end is positioned within an interior of the housing.

8. The pneumatic valve device of claim 7, wherein the tube is configured such that upon final assembly, the outlet end extends within the housing to a height approximately 40%–60% of a height of the housing.

9. The pneumatic valve device of claim 3, wherein the fibers are polyester.

10. A muffler for attenuating noise produced at an exhaust port of a pneumatic device, the muffler comprising:

a housing defining an upstream end and a downstream end, the downstream end being closed, wherein at least a portion of the housing tapers in width to the downstream end and the housing has a maximum exterior width of less than 38 mm;

a base secured to the housing at the upstream end, the base including an inlet tube for directing airflow and sound waves from the exhaust port into the housing; and an acoustic absorption insert disposed within the housing, the insert including a web of fibers configured to absorb sound waves.

11. A muffler for attenuating noise produced at an exhaust port of a pneumatic device, the muffler comprising:

a housing defining an upstream end and a downstream end, the downstream end being closed, wherein at least a portion of the housing tapers in width to the downstream end;

a base secured to the housing at the upstream end, the base including an inlet tube for directing airflow and sound waves from the exhaust port into the housing; and an acoustic absorption insert disposed within the housing, the insert including a web of fibers configured to absorb sound waves;

wherein the housing and the base combine to define an extension length upon assembly to an exhaust port, the extension length being less than approximately 38 mm.

12. A muffler for attenuating noise produced at an exhaust port of a pneumatic device, the muffler comprising:

a housing defining an upstream end and a downstream end, the downstream end being closed, wherein the housing includes a side wall extending between the upstream end and the downstream end, the side wall forming a continuous barrier to sound waves from an interior of the housing and at least a portion of the housing tapers in width to the downstream end;

a base secured to the housing at the upstream end, the base including an inlet tube for directing airflow and sound waves from the exhaust port into the housing; and an acoustic absorption insert disposed within the housing, the insert including a web of fibers configured to absorb sound waves.

13. The muffler of claim 4, wherein the side wall defines a first section extending from the upstream end and a second section extending from the first section to the downstream end, and wherein the first section is configured to receive the base.

14. A muffler for attenuating noise produced at an exhaust port of a pneumatic device, the muffler comprising:

a housing defining an upstream end and a downstream end, the downstream end being closed, wherein at least a portion of the housing tapers in width to the downstream end and the housing includes a side wall extending between the upstream end and the downstream end, the side wall forming a continuous barrier to sound waves from an interior of the housing and wherein a portion of the side wall has a thickness in the range of approximately 0.76–2.3 mm;

a base secured to the housing at the upstream end, the base including an inlet tube for directing airflow and sound waves from the exhaust port into the housing; and an acoustic absorption insert disposed within the housing, the insert including a web of fibers configured to absorb sound waves.

15. A muffler for attenuating noise produced at an exhaust port of a pneumatic device, the muffler comprising:

a housing defining an upstream end and a downstream end, the downstream end being closed, wherein at least a portion of the housing tapers in width to the downstream end and the housing includes a side wall extending between the upstream end and the downstream end, the side wall forming a continuous barrier to sound waves from an interior of the housing and wherein the side wall defines a diameter of the housing, at least a portion of the side wall tapering in diameter from the upstream end to the downstream end, and further wherein the side wall taper forms an included angle in the range of approximately 30°–50°;

a base secured to the housing at the upstream end, the base including an inlet tube for directing airflow and sound waves from the exhaust port into the housing; and an acoustic absorption insert disposed within the housing, the insert including a web of fibers configured to absorb sound waves.

16. A muffler for attenuating noise produced at an exhaust port of a pneumatic device, the muffler comprising:

a housing defining an upstream end and a downstream end, the downstream end being closed, wherein at least a portion of the housing tapers in width to the downstream end and the housing includes a side wall extending between the upstream end and the downstream end, the side wall forming a continuous barrier to sound waves from an interior of the housing and wherein the side wall defines a first section extending from the upstream end and a second section extending from the first section to the downstream end;

a base secured to the housing at the upstream end, the base including an inlet tube for directing airflow and sound waves from the exhaust port into the housing; and an acoustic absorption insert disposed within the housing, the insert including a web of fibers configured to absorb sound waves; and wherein the first section is substantially cylindrical and the second section is substantially frusto-conical, tapering in diameter to the downstream end and the first section is configured to receive the base.

17. A muffler for attenuating noise produced at an exhaust port of a pneumatic device, the muffler comprising:

a housing defining an upstream end and a downstream end, the downstream end being closed, wherein at least a portion of the housing tapers in width to the downstream end;

a base secured to the housing at the upstream end, the base including an inlet tube for directing airflow and sound waves from the exhaust port into the housing and wherein the base further includes an inlet wall extending in a generally radial fashion from the tube and an annular flange extending from the inlet wall opposite the tube; and an acoustic absorption insert disposed within the housing, the insert including a web of fibers configured to absorb sound waves.

18. The muffler of claim 17, wherein the annular flange is sealed to the housing.

19. A muffler for attenuating noise produced at an exhaust port of a pneumatic device, the muffler comprising:

a housing defining an upstream end and a downstream end, the downstream end being closed, wherein at least a portion of the housing tapers in width to the downstream end;

a base secured to the housing at the upstream end, the base including an inlet tube for directing airflow and sound waves from the exhaust port into the housing and wherein the base forms at least one passage apart from the tube for allowing airflow outwardly from the housing; and an acoustic absorption insert disposed within the housing, the insert including a web of fibers configured to absorb sound waves.

20. A muffler for attenuating noise produced at an exhaust port of a pneumatic device, the muffler comprising:

a housing defining an upstream end and a downstream end, the downstream end being closed, wherein at least a portion of the housing tapers in width to the downstream end;

a base secured to the housing at the upstream end, the base including an inlet tube for directing airflow and sound waves from the exhaust port into the housing and wherein the tube defines an inlet end and an outlet end, and further wherein upon final assembly, the outlet end is positioned within an interior of the housing; and an acoustic absorption insert disposed within the housing, the insert including a web of fibers configured to absorb sound waves.

21. The muffler of claim 20, wherein the tube is configured such that upon final assembly, the outlet end extends within the housing to height approximately 40%–60% of a height of the housing.

22. The muffler of claim 20, wherein the acoustic absorption insert is continuous between the outlet end of the tube and the downstream end of the housing.

23. A muffler for attenuating noise produced at an exhaust port of a pneumatic device, the muffler comprising:

a housing defining an upstream end and a downstream end, the downstream end being closed, wherein at least a portion of the housing tapers in width to the downstream end;

a base secured to the housing at the upstream end, the base including an inlet tube for directing airflow and sound waves from the exhaust port into the housing; and an acoustic absorption insert disposed within the housing, the insert including a web of fibers configured to absorb sound waves, wherein the fibers have a fineness in the range of approximately 5–50 denier.

24. A muffler for attenuating noise produced at an exhaust port of a pneumatic device, the muffler comprising:

a housing defining an upstream end and a downstream end, the downstream end being closed, wherein at least a portion of the housing tapers in width to the downstream end;

a base secured to the housing at the upstream end, the base including an inlet tube for directing airflow and sound waves from the exhaust port into the housing; and an acoustic absorption insert disposed within the housing, the insert including a web of fibers configured to absorb sound waves, wherein the fibers comprise polyester and the acoustic absorption insert has a volume in the range of approximately $8\times10^3$–$33\times10^3$ $mm^3$ and a mass in the range of approximately 0.25–1.0 gram.

25. A muffler for attenuating noise produced at an exhaust port of a pneumatic device, the muffler comprising:

a housing defining an upstream end and a downstream end, the downstream end being closed, wherein the housing has a maximum exterior width less than approximately 38 mm;

a base secured to the housing at the upstream end, the base including a tube for directing airflow and sound waves from an exhaust port into the housing; and an acoustic absorption insert disposed within the housing, the insert including a web of fibers configured to absorb sound waves.

26. A pneumatic valve device comprising:

a pneumatic valve forming an exhaust port; and a muffler in accordance with claim 25 fluidly connected to the exhaust port.

27. The pneumatic valve device of claim 26, wherein at least a portion of the housing tapers in width to the downstream end.

28. The pneumatic valve device of claim 26, wherein the housing and the base combine to define an extension length upon assembly to an exhaust port, the extension length being less than approximately 38 mm.

29. The pneumatic valve device of claim 26, wherein the housing includes a side wall, at least a portion of the side wall having a thickness in the range of approximately 0.76–2.3 mm.

30. The pneumatic valve device of claim 26, wherein the tube is configured such that upon final assembly, the outlet end extends within the housing to a height approximately 40%–60% of a height of the housing.

31. The pneumatic valve device of claim 26, the acoustic absorption insert has a volume in the range of approximately $8.0\times10^3$–$33\times10^3$ $mm^3$ and a mass in the range of approximately 0.25–1.0 gram.

32. The muffler of claim 25, wherein at least a portion of the housing tapers in width to the downstream end.

33. The muffler of claim 25, wherein the housing and the base combine to define an extension length upon assembly to an exhaust port, the extension length being less than approximately 38 mm.

34. The muffler of claim 25, wherein the housing includes a side wall, at least a portion of the side wall having a thickness in the range of approximately 0.76–2.3 mm.

35. The muffler of claim 25, wherein the housing includes a side wall extending from the upstream end to the downstream end, at least a portion of the side wall tapering in diameter to the downstream end to form an included angle in the range of approximately 30°–50°.

36. The muffler of claim 25, wherein the base further includes an inlet wall extending in a generally radial fashion from the tube, the inlet wall forming at least one passage for allowing airflow outwardly from the housing.

37. The muffler of claim 25, wherein the tube defines an inlet end and an outlet end, and further wherein upon final assembly, the outlet end is positioned within an interior of the housing.

38. The muffler of claim 37, wherein the tube is configured such that upon final assembly, the outlet end extends within the housing to a height approximately 40%–60% of a height of the housing.

39. The muffler of claim 37, wherein the acoustic absorption insert is continuous between the outlet end of the tube and the downstream end of the housing.

40. The muffler of claim 25, wherein the acoustic absorption insert has a volume in the range of approximately $8.0\times10^3$–$33\times10^3$ $mm^3$ and a mass in the range of approximately 0.25–1.0 gram.

41. A muffler for attenuating noise produced at an exhaust port of a pneumatic device, the muffler comprising:

a housing defining an upstream end and a downstream end, the downstream end being closed, wherein the housing tapers from a maximum exterior width of less than 38 mm at the upstream end to the downstream end;

a base secured to the housing at the upstream end, the base including a tube for directing airflow and sound waves from an exhaust port into the housing; and an acoustic absorption insert disposed within the housing, the insert including a web of fibers configured to absorb sound waves.

42. The muffler of claim 41, wherein the housing and the base combine to define an extension length upon assembly to an exhaust port, the extension length being less than approximately 38 mm.

43. The muffler of claim 41, wherein the housing includes a side wall extending between the upstream end and the downstream end, the side wall forming a continuous barrier to sound waves.

44. The muffler of claim 41, wherein the base further includes an inlet wall extending in a generally radial fashion from the tube, and further wherein the inlet wall forms at least one passage for allowing air flow outwardly from the housing.

45. The muffler of claim 41, wherein the tube includes an inlet end and an outlet end and is configured such that upon final assembly, the outlet end is approximately equidistant between the upstream end and the downstream end of the housing.

46. The muffler of claim 41, wherein the acoustic absorption insert has a volume in the range of approximately $8.0\times10^3$–$33\times10^3$ $mm^3$ and a mass in the range of approximately 0.25–1.0 gram.

* * * * *